US005465432A

United States Patent [19]

Miller

[11] Patent Number: 5,465,432

[45] Date of Patent: Nov. 14, 1995

[54] DEVICE TO SECURE TOILET FLUSH LEVER ARM TO EFFECT A PARTIAL FLUSH

[76] Inventor: John B. Miller, 110 W. Los Robles, Green Valley, Ariz. 85614

[21] Appl. No.: 165,631

[22] Filed: Dec. 13, 1993

[51] Int. Cl.[6] ..... E03D 1/14

[52] U.S. Cl. ..... 4/325

[58] Field of Search ..... 4/324, 325

[56] References Cited

U.S. PATENT DOCUMENTS

| | | | |
|---|---|---|---|
| 2,922,168 | 1/1960 | Crandall | 4/384 |
| 4,764,995 | 8/1988 | Harney | 4/325 |
| 4,881,279 | 11/1989 | Harney | 4/325 |

*Primary Examiner*—Charles F. Phillips
*Attorney, Agent, or Firm*—J. Michael McClanahan

[57] ABSTRACT

An improvement for a dual flush mechanism which permits a partial flush of a toilet in addition to the full flush. When the operator pushes the partial flush handle down, the partial flush mechanism lifts the flapper valve off the annular valve seat a small distance by raising the connected flush lever arm a similarly small distance. The improvement is a flush lever arm holder adapted to suspend the flush lever arm in the slightly raised partial flush position after the operator has released the partial flush handle. More particularly, a rotatable cam resides on a plate secured to the toilet tank wall, the cam, operably attached to a float, engages the underside of the flush lever arm such that the float holds the rotatable cam under the flush lever arm to secure it in the raised position during the partial flush. As the water level in the toilet tank falls, the float begins to fall with the water and lowers the cam holding up the flush lever arm. The flush lever arm descends allowing the flapper valve to cover the annular valve seat, terminating the partial flush. The toilet tank begins to refill and the float again urges the cam against the underside of the flush lever arm, but is insufficiently buoyant to raise the flapper valve off the valve seat. It sits there awaiting the operator to push the partial flush handle again.

10 Claims, 4 Drawing Sheets

DEVICE TO SECURE TOILET FLUSH LEVER ARM TO EFFECT A PARTIAL FLUSH

BACKGROUND OF THE INVENTION

1. Field of the Invention

This invention relates generally to improvements to flush toilets to effect partial flushes of the toilet.

2. Description of the Prior Art

It is well known that in operation of the common flush toilet, the flapper valve which controls the flow of water through the drain at the bottom of the toilet may be utilized to effect a partial flush. If, after the flapper valve has been lifted from the valve seat encircling the drain, the flapper valve is returned to the valve seat after a set amount of water has flowed from the toilet tank reservoir into the toilet bowl, a partial flush has been accomplished.

Generally, a partial flush of the toilet utilizing one-half to one-third of the total water stored in the toilet tank is satisfactorily if one wishes only to flush away liquid wastes. Full flushes utilizing all the water contained in the toilet tank are necessary only when disposing of solid wastes. As a consequence, since liquid wastes are flushed from the toilet probably three out of four times that a toilet is used, great savings in water and costs are possible if partial flushes are utilized for disposal of liquid wastes rather than a full flush.

Flushing of a toilet utilizing a conventional flush mechanism is controlled by an operator manipulating a handle situated on the outside of the toilet tank. The operator presses down on the handle, initiating a rotation of the handle which in turn rotates upward a connected flush lever arm interiorly to the toilet tank, the resultant being a lifting of the distal end of the lever arm. To this distal end is attached a chain or string, the other end of which is attached to the flapper valve residing on the valve seat situated at the bottom of the tank. By lifting the flapper valve, presently done by rotating the flapper valve off the valve seat, water is permitted to flow through a drain centrally located in the valve seat and into the toilet bowl. When an operator fully depresses the flush handle, the flapper valve is raised up to a position sufficiently high above the valve seat so that the flapper valve becomes buoyant and does not return to the valve seat until all the water in the tank has drained.

An operator may effect a partial flush by depressing the flush handle a small amount rather than a full swing to thereby lift the lever arm a correspondingly small distance, whereupon the flapper valve will be lifted off the valve seat a corresponding small distance. In this scenario, the flapper valve will return to the valve seat when the operator releases the flush handle. The difficulty with this operation is that a person must be skilled in depressing the flush handles only a small portion of its total rotational travel as there is a tendency to push the full amount of travel.

Accordingly, a number of efforts have been devoted to providing mechanical means to acomplish partial flushes of a toilet wherein only a portion of the water stored in the toilet tank is used. One such device is shown in the 1989 United States Patent to Randall Toltzman, U.S. Pat. No. 4,864,665, entitled "DUAL FLUSH SYSTEM FOR TOILETS", the present inventor being the Assignee. The invention of this patent provides a pair of overlapping flush handles situated outside the toilet tank, one adapted to provide for a partial flush of the toilet and the second adapted to provide for a full flush. The partial flush handle operates through the flush lever arm interior to the tank to lift the flapper valve off the valve seat a short distance, in the order of a half an inch or so, to allow water to pass out of the toilet tank and into the toilet bowl. If the partial flush handle is depressed for about six seconds, sufficient water will have drained from the toilet tank into the toilet bowl to effect a partial flush. After six seconds or so has elapsed, the operator releases the partial flush handle and the flapper valve returns to its seated position upon the valve seat, thereby terminating the flow of water into the toilet bowl.

The flapper valve returns to the valve seat due to a number of factors, these factors believed to include the water pressure being exerted vertically down upon the flapper valve, and the suction of the water rushing past the sides of the cone shaped flapper valve into the centrally located drainway of the valve seat. When the flapper valve is no longer forcible held immediately above, but closely spaced to, the valve seat, the flapper valve will automatically return to the valve seat and terminate water flow.

When the flapper valve is raised to a position sufficiently high above the valve seat, the downward pressure of water upon the flapper valve and the suction upon the flapper valve is insufficient to overcome the inherent buoyancy of the flapper valve and the flapper valve rises to its highest most position (the flapper valve in most cases being pivoting on and off the seat valve). When the flapper valve has become buoyant, substantially all the water in the toilet tank flows into the toilet bowl. This is a full flush.

The invention of Toltzman works very well and does in fact accomplish both a partial flush and a full flush of the toilet (the full flush through the full flush handle). Yet, the instant inventor has found that operators are not usually willing to hold the partial flush lever down the required six seconds or so necessary to effect a partial flush. In most cases, the operator will push the partial flush lever down to begin the flush of the toilet, but will release the lever a second or two later. This allows the flush lever arm operably connected to the partial flush handle to move downward to its at-rest lowest position. Then the flapper valve connected to the flush lever arm is no longer suspended immediately above the valve seat and will return to the valve seat and terminate the flow of water. Unfortunately, insufficient water flows in that one to two second hold down period to effect a partial flush and thus the purpose of the invention is thwarped. Since the attempt of a partial flush has failed, the operator may then push the full flush handle which, also being operably connected to the flush lever arm, lifts the lever arm fully up, pulling the flapper valve off the valve seat high enough to become buoyant and a full flush results.

Another invention by which both a partial flush and a full flush may be effected in a toilet is shown by the patent to E. M. Gram, U.S. Pat. No. 2,744,261, issued May 8, 1956. In the invention of Gram, the outside toilet handle is directly attached to a cam inside the toilet tank. The cam operates upon one end of an independent flush lever arm by raising the second end of the lever arm to one set height when in the partial flush mode of operation, and then raising the second end to a higher level for the full flush mode. The above is accomplished by placing the fulcrum or pivot point of the independent flush lever arm generally central between its two ends. The first end is proximate the flush handle cam and the second end has attached to it the chain or string which connects to the flapper valve. Then, one lobe of the cam operates against the first end of the flush lever arm to depress the flush lever arm a relatively short distance which raises the second end of the flush lever arm a correspondingly short distance necessary for a partial flush. To accomplish this the flush handle is rotated up. For a full flush, the flush handle is rotated down whereupon a second larger lobe of the cam depresses the first end of the flush lever arm a greater distance, thus lifting the second end of the lever arm the necessary higher distance to raise the flapper sufficient to become buoyant.

The shortcoming of Gram's invention is that it does not conform to conventional methods of flushing toilets by pushing handle(s) down to accomodate both a partial flush and a full flush.

Accordingly, while the invention of Toltzman does adopt conventional flushing methods by pushing handles down to effect a partial and full flush, yet it also suffers from the shortcomings cited above.

Thus it becomes quite obvious that it would advantageous to have a device which assists an operator in accomplishing partial flushes of a toilet, whether or not the invention of Toltzman is installed on the toilet. Such device would have to hold up the flush lever arm at the proper height for the requisite time of a partial flush after the operator initially raised the lever arm, especially for those cases where the operator will not continue to hold the partial flush handle down. Such a device, however, must release the flush lever arm when sufficient water has passed into the toilet bowl to effect the partial flush so that the partial flush is terminated.

SUMMARY OF THE INVENTION

The embodiment of the invention described consists of a device adapted to hold up the flush lever arm in a toilet tank at the required height for a partial flush once the lever arm was lifted to that height by an operator pushing down on the flush handle.

More particularly, the invention consists of a rotatable cam which, when the flush lever arm is operably lifted by an operator, rotates an attached outwardly protruding pin to a position under the flush lever arm so that when the operator releases the handle lifting the lever arm, the lever arm rests upon the pin so as to suspend the lever arm at the height necessary to continue the partial flush. Upon the falling of the water level in the tank to a level indicative that sufficient water has passed from the toilet tank into the toilet bowl to effect the partial flush, the cam operably supporting the flush lever arm rotates such as to place the pin at a lower position, allowing the flush lever arm to return to its lower most at-rest position and the flapper valve to return to the valve seat.

Both the rotating of the cam up under the flush lever arm, and the rotation of the cam out from holding the flush lever arm is accomplished by a single float element. For example, once the flush lever arm has been raised by the operator, the float element rotates the cam in order that the outstanding pin move up under the flush lever arm so that if the operator is effecting a partial flush, the flush lever arm is secured at the slightly raised position to complete the partial flush after the operator has released the partial flush handle.

Then, as the water level in the tank falls to the point where the float is only partially covered with water, the flush lever arm, having a downward force exerted upon it by the connected flapper valve attempting to return to the valve seat, and the float following the water level, allows for rotation of the cam supporting the flush lever arm in the heightened position. This allows the flush lever arm to return to its rest position and the flapper valve to cover the valve seat, terminating the flow of water into the toilet bowl and the partial flush. Naturally, the float element must be of a size to have a sufficient upward buoyancy force to hold the flush lever arm up against the downward force exerted on it by the flapper valve.

The invention is constructed from a flat base plate which is secured to the inside wall of the toilet tank proximate the opening through the tank through which the flush handle passes, and near the to of the tank. The plate is held in place by one of several methods, the preferred one being that a portion of the plate passes underneath the nut which secures the flush handle and lever arm mechanism to the tank wall. By such means the base plate is firmly held in place. Alternative means include placing an adhesive on the back of the base plate fastening the base plate to the inside surface of the wall.

To this base plate is rotationally attached a right angled cam, one end of one leg of the cam rotating about a pivot pin which protrudes transversely from the plane of the base plate. At the center point right angle of the cam is an outwardly protruding pin, this pin being the actual mechanism which has contact with the underside of the flush lever arm, supporting it in the partial flush position. Pivotally attached to the distal end of the second leg of the cam is one end of an elongated extension member. At the other end of the extension member is attached a float element. The position of the float on the extension member is adjustable in accordance to where, in terms of the water level in the tank, the operator wishes the partial flush to terminate. The extension member also slides up and down between two securing guides, the guides being attached to the base plate. The invention is placed on the upper part of the inside front wall of the toilet tank secured by the nut holding the flush mechanism in place. In this position, the pin attached to the cam resides underneath the flush lever arm, being held up by the float. The flush lever arm is connected to the flapper valve by means of a chain or string, the slack in the string or chain being taken out by the cam lifting the flush lever arm. However, upward pressure on the flush lever arm exerted by the cam is not sufficient to lift the flapper valve off the valve seat.

When the operator raises the flush lever arm by depressing the partial flush handle on the outside of the toilet, the flush lever arm is immediately raised from its at-rest position. This frees the cam and it begins to rotate counterclockwise due to the action of the float lifting up on the extension member, the rotation of the cam effectively raising the height of the pin to a point under the flush lever arm. The cam raises the pin at a slower rate than the flush lever arm is usually raised by the operator but, the cam will fully rotate to engage the flush lever arm before one or two seconds has passed, the length of time that the operator would normally depress the partial flush handle.

When the operator releases the partial flush handle, the flush lever arm transfers its downward force to the pin protruding from the cam. This places pressure upon the pin which is resisted by the upward buoyancy of the float. The flush lever arm is held in this raised up position.

When the water level in the toilet tank has fallen to the point to where the float element is no longer covered with water or, no longer sufficiently buoyant to hold up the flush lever arm, the cam rotates to its lowest position and allows the flush lever arm to return to its at-rest position. The flapper valve seals the valve seat, the partial flush terminates and the toilet tank begins to refill.

As the water rises in the toilet, it begins to encompass the float element, exerting a upward force on the extension member due to buoyancy of the float element. This exerts a force on the cam to rotate it back (counter-clockwise) to its upper most position, however, as it engages the flush lever arm, the force holding the flush lever arm down is sufficient to resist further upward movement of the cam. All slack is taken out of line connecting the flush lever arm to the flapper valve and the invention stays cocked for the next use of the operator. Here, the size of the float must not be so large that its upward buoyancy force is able to lift the flapper valve off the valve seat.

In an alternate embodiment of the invention, an upper stop is situated on the base plate such that the cam is permitted to rotate under the flush lever arm to a counterclockwise position where the location of the protruding pin is a few degrees beyond to dead center. Top dead center is defined as the point where a line perpendicular to the flush lever arm passes through the center of the pivot point of the cam. In this configuration, the cam is locked in position as the flush lever arm presses down upon the outstanding pin when the operator releases the partial flush handle. At this point, the invention does not depend upon the float to resist the downward force of the flush lever arm, but the flush lever arm is secured by the cam having rotated to the locked position.

Then, when the water level falls near or below the float, the weight of the float itself now pulls the connecting extension member downward to rotate the cam clockwise and from the position under the flush lever arm. Since the pin holding the flush lever arm was only a few degrees past to dead center, the weight of the float is sufficient to slide the pin (substantially horizontally) across the underside of the flush lever arm and then rotate the cam back to its position prior to the initiation of the partial flush.

In a second embodiment of the invention, two opposite but heavier than water weights are utilized, the weights attached on opposite ends of arms connected to the cam. The weights are so situated that a first weight normally resides outside the water, above the full or top level of the water, and a second heavier weight resides beneath the water. Here again, the cam rotates around a pivot pin and has a protruding pin which comes up under the flush lever arm. Starting from the same cocked or ready position, when the flush lever arm is raised, the weight above the water pulls down on the end of its arm and rotates the cam pin to a position underneath the up raised flush lever arm. The first weight never enters the water. The second weight, which was under water, is buoyed up by the weight of the water that the weight displaces (even though the weight itself is not fully buoyant). The apparent weight of the second weight is less than the actual weight of the first so long as the second weight is under water. When the water level falls to the point where the second weight attached to the second end of the balance arm is no longer covered with water, its weight, being greater than the first weight, now rotates the cam back to its original position, thus allowing the flush lever arm to return to its original position and the flapper valve to re-seal upon the valve seat, ending the partial flush.

Accordingly, it is an object of the subject invention to provide means to support the flush lever arm in a partial flush position whereby the exit of water from the toilet tank may be controlled to effect a partial flush.

It is another object of the subject invention to provide means supporting a flush lever arm at a partial flush position wherein the means is permitted to operate after the flush lever arm has been initially raised.

It is still another object of the subject invention to provide means to support the flush lever arm of a toilet in a partial flush position, the means including a rotatable cam whose operation is controlled by a float element.

Other objects of the invention will in part be obvious and will in part appear herein after. The invention accordingly comprises the apparatus possessing the construction, combination of elements, and arrangement of parts which are exemplified in the following detailed disclosure and the scope of the Application which will be indicated in the claims.

BRIEF DESCRIPTION OF THE DRAWINGS

For further understanding of the features and objects of the subject invention, reference should be made to the following detailed description taken in combination with the accompanying drawings wherein.

In various views, like index numbers refer to like elements.

DETAILED DESCRIPTION OF THE PREFERRED EMBODIMENT

Figure 1:
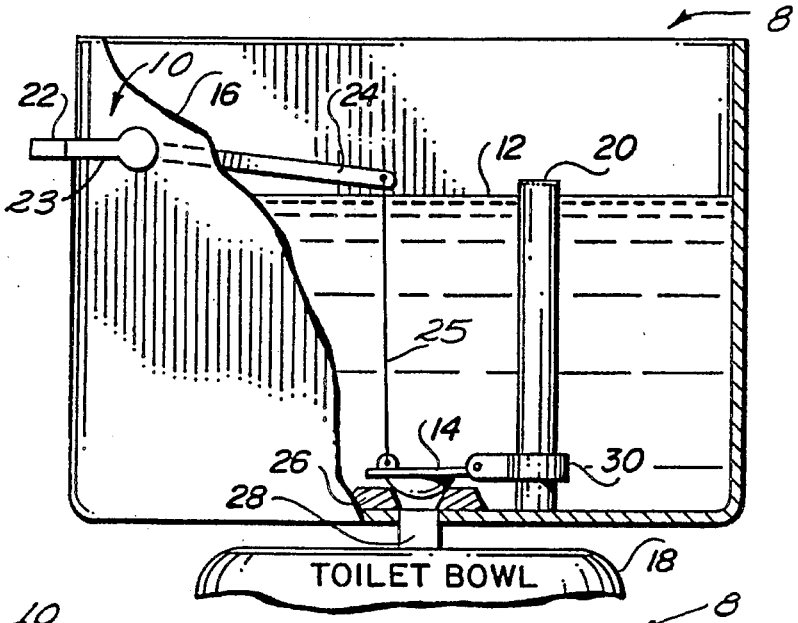
FIG. 1 (PRIOR ART)
FIG. 1 is a front elevational view of a toilet tank with a prior art dual flush mechanism shown.
Figure 2:
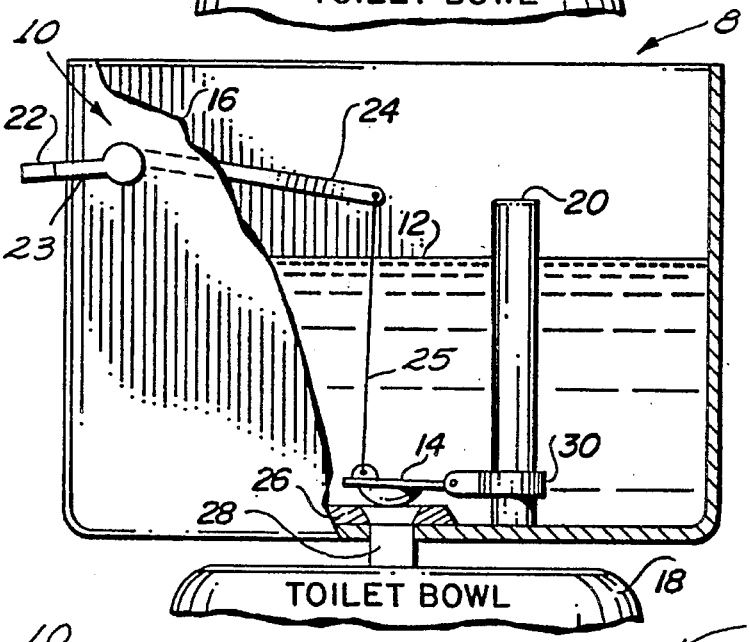
FIG. 2 (PRIOR ART)
FIG. 2 is a front elevational sectional view of a toilet tank with the prior art dual flush mechanism in the partial flush position.
Figure 3:
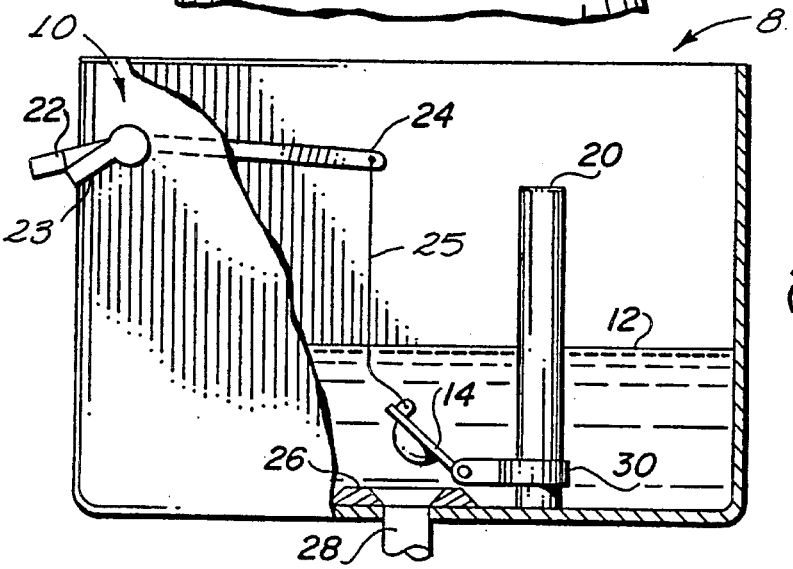
FIG. 3 (PRIOR ART)
FIG. 3 is a front elevational sectional view of a toilet tank showing the prior art dual flush mechanism in the full flush mode.

FIGS. 1 through 3 show the prior art illustrating a partial flush in a toilet assembly being accomplished by lifting the flapper valve off the valve seat a short distance such that the flapper valve does not become buoyant. The flapper valve is returned to its resting position on the valve seat after a set amount of time in order that a pre-determined amount of water may escape from the tank and the partial flush is completed. More particularly, in FIGS. 1–3, a front elevation view is shown of toilet tank reservoir 8 with its front wall 16 in partial section to reveal the contents of the tank.

Inside toilet tank reservoir 8 is standing water, shown by water level 12, and overflow pipe 20 which drains water into toilet bowl 18 whenever water level 12 exceeds the height of the overflow pipe. Situated in the bottom of toilet tank 8 is annular valve seat 26 whose center opening leads to connecting pipe 28, which in turn is attached to toilet bowl 18. Residing in blocking position of the center opening of valve seat 26 is flapper valve 14, flapper valve 14 pivotally attached to flapper valve support 30. Flapper valve 14 is constructed from a soft pliable rubber or plastic having a bulbous portion conforming to the periphery of the inner opening of valve seat 26. The bulbous portion forms a seal to prevent the flow of water through valve seat through connecting pipe 28, and into toilet bowl 18 when flapper valve 14 resides upon valve seat 26.

Connecting to flapper valve 14 by means of flexible chain or string 25 is flush lever arm 24, lever arm 24 being a part of dual flush mechanism 10. Dual flush mechanism 10 is the invention of Randall R. Toltzman, U.S. Pat. No. 4,864,665, assigned to the Applicant, which provides a dual flush system for toilets. Dual flush mechanism 10 operates through two handles, an elongated partial flush handle 22 and a shorter overlying full flush handle 23. The handles are so arranged that when the longer partial flush handle 22 is depressed to its full extent, flush lever arm 24 is raised a pre-determined set distance. This is illustrated in FIG. 2. It is noted that when partial flush handle 22 is depressed, full flush handle 23 also comes with it.

Referring particularly to FIG. 2, and with partial flush handle 22 depressed its full amount, lever arm 24 has raised flapper valve 14 off valve seat 26 only a short distance, allowing water to escape from tank 8 into the central opening of valve seat 26 and down into toilet bowl 18. So long as partial flush handle 22 is depressed, flapper valve 14 is lifted off valve seat 26 and water flows. It has been determined from experimentation that sufficient water escapes from tank 8 in approximately 6 seconds to effect a partial flush of the toilet, that flush principally for the purposes of carrying away liquid wastes. At the end of the six second interval (or a long as the operator should keep partial flush handle 22 depressed), partial flush handle 22 is released. This allows lever arm 24 to return to its at rest position (FIG. 1) and flapper valve 14 to return to its seated position covering the opening through valve seat 26. This terminates the partial flush. It is noted in FIG. 2 that water level 12 has fallen by a few inches.

For purposes of illustrating a full flush, FIG. 3 shows full flush handle 23, which was previously aligned with partial flush handle 22, further depressed. By pressing full flush handle 23 downward to its full limit, flush lever arm 24 is raised even higher above its partial flush position. This raises flapper valve 14 to an even higher position and to the point where flapper valve 14 itself becomes buoyant and moves as far away from valve seat 26 as it may get. At this point, a full flush has commenced. The operator may release the full flush handle, but flapper valve 14 stays upright. When the water level falls to the vicinity of flapper valve 14, it begins to float on the surface of the water. When water level 12 reaches near the bottom of tank 8, flapper valve 14 returns to valve seat 26 and the full flush is completed. Full flushes are designed to remove both liquid and solid waste from the toilet.

It is noted that a full flush may also be achieved by the operator continually depressing the partial flush lever until all the water has drained from the toilet tank.

The invention of Toltzman illustrated in FIGS. 1–3 works perfectly for the task for which it was designed, however, the inventor has discovered that most operators utilizing flush mechanism 10 are not willing to hold partial flush lever 22 down for the time necessary to effect a partial flush (about 6 seconds) and accordingly, the invention has not been fully utilized as it should.

The instant inventor knows that while utilizing the Toltzman partial flush mechanism he must determine when a partial flush is sufficient by either watching the water in the toilet bowl, or mentally counting for the requisite six seconds or so. Faced with this problem, the inventor needed a device by which the flush lever arm 24 may be held in a partial flush position for the requisite time without the operator doing anything more than initiating the partial flush by pushing partial flush handle 22 down to its stop.

However, there are gages other than time to determine when sufficient water has entered the toilet bowl to effect a partial flush, and that may be the falling level of the water interiorly to tank 8. The water level is not usually readily seen by the operator, but, varied mechanisms may be used to determine the drop in the water level interiorly to the toilet tank. Accordingly, the inventor has invented the subject flush lever arm holding mechanism shown in a perspective view in FIG. 4 to sense a drop in water level.

Figure 4:
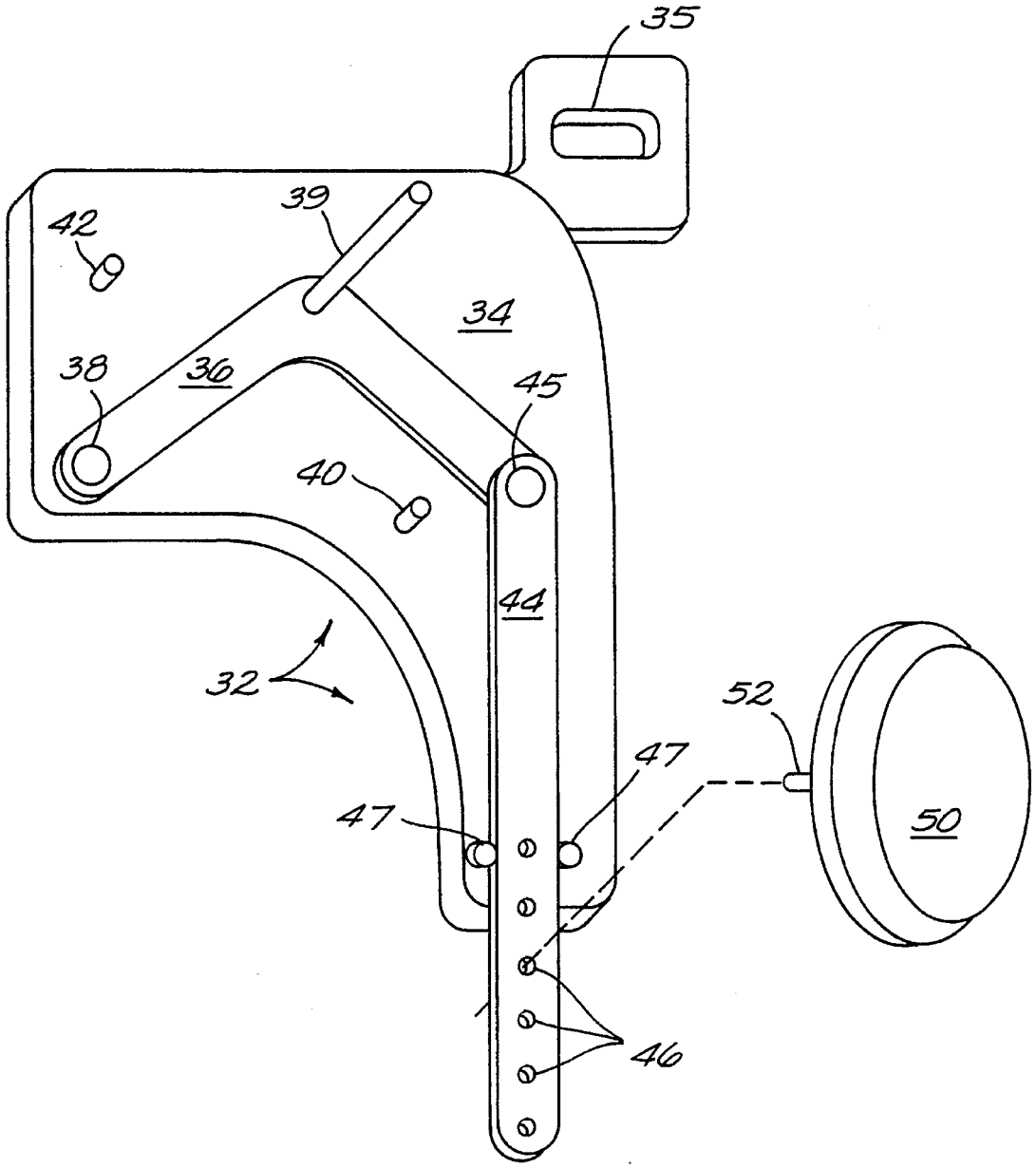
FIG. 4 is a perspective view of the subject invention.

Referring now to FIG. 4, the subject invention is shown, the device for attachment to the inside front wall 16 of toilet tank 8. More particularly, the inventive flush lever arm holder mechanism 32 comprises a flat base plate 34 upon which single angled cam 36 resides in pivotal relationship. This pivotal relationship is accomplished through means of pin 38 pivotally attaching a first end of cam 36 to base plate 34. Cam 36 moves through an arc defined by movement between lower stop 40 and upper stop 42. Both stops 40 and 42 are short cylinders attached to base plate 34 which are of height such as only to intersect cam 36. At the distal end of cam 36 is pin 45 pivotally attaching extension member 44. Extension member 44 is an elongated rod with two lengthwise oppositely situated channels or grooves formed down its length to enable extension member 44 to slide longitudinally between spaced apart guides 47 attached to base plate 34. Guides 47 each have a rounded disk like head mounted to a shaft, a portion of each disk protruding into opposite lengthwise grooves of extension member 44. By such arrangement, extension member 44 is permitted to slide substantially vertically up and down between guides 47. In the lower portion of extension member 44 are a plurality of openings or holes 46 to be utilized in connection with a float. Immediately to the right of extension member 44 is float 50, float 50 in the preferred embodiment being an air filled plastic bladder with centrally located outwardly protruding boss 52 adapted to be received in one of holes 46.

Since base plate 34 is to reside upon the inside wall 16 of toilet tank 8, means are necessary to secure the plate to the inside of the wall. To that end, base plate 34 has at one corner elongated rectangular opening 35. Base plate 34 is secured under the nut which secures the dual flush mechanism 10 (FIGS. 1–3) to front wall 16, the area of plate 34 immediately surrounding opening 35 functioning much like a washer. Opening 35 is rectangularly constructed in order that base plate 34 may be oriented at various horizontal positions so as to accommodate the flush lever arm of the dual flush mechanism in its best operating location. Of course, it is obvious that an adhesive could be placed upon the back of base plate 34 to serve the same purpose as the tightened nut of the dual flush mechanism, however, in such a case, once the invention were placed, further adjustment through the elongated rectangular opening would be lost. Also, the invention would not be easily removed for use on other toilets.

Figure 5:
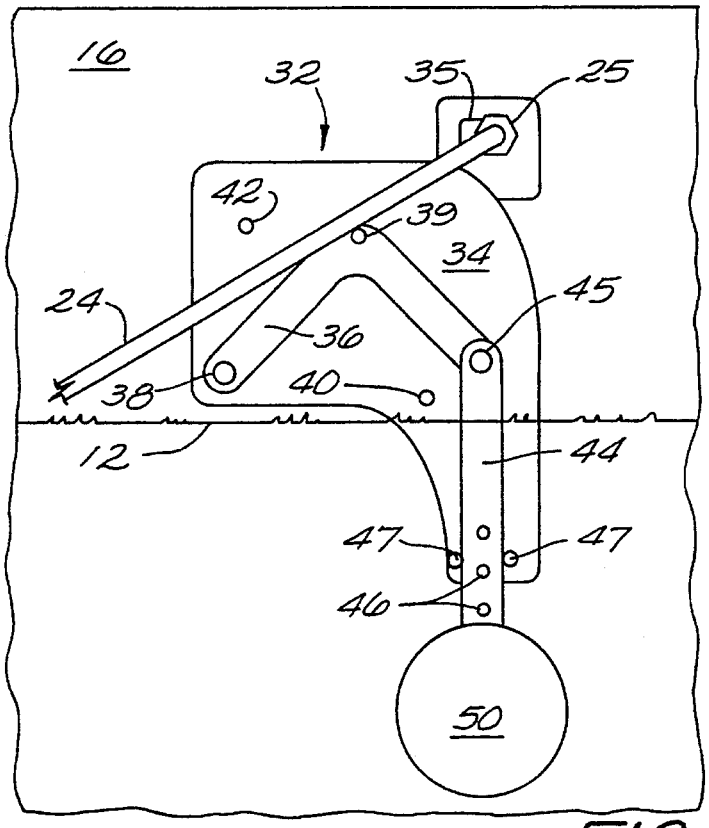
FIG. 5 is a front elevational view of the subject invention in its at-rest position.

Lastly, located somewhat centrally to cam 36 and proximate the cam's right angle is horizontal outwardly protruding elongated pin 39 adapted to engage the underside of flush lever arm 24 (FIGS. 1–3) to hold the arm up for the period of time necessary for the unassisted partial flush of the toilet.

operation of the invention will become readily apparent as the invention is shown in place attached to the inside surface of the front wall of the toilet tank. Specifically, referring now to FIG. 5, a front elevation view of the inventive flush lever arm holder mechanism is shown situated upon front wall 16 of the toilet tank reservoir where it may operate on flush lever arm 24 of the dual flush mechanism. More particularly, shown in FIG. 5 is the inventive flush lever arm holder 32 with float 50 attached to elongated extension member 44 by means of boss 55 (FIG. 4) pressed into one of the tight fitting holes 46. The purpose of having extension member 44 and variably attachable float 50 as two separate elements is to permit adjustment of the vertical position of float 50 in order to determine which resulting water level accomplishes the best partial flush.

Also shown in FIG. 5 is a portion of flush lever arm 24 of the dual flush mechanism, the flush lever arm emerging from the opening through front wall 16, and the dual flush mechanism being secured by holding nut 25, the same holding nut being the means by which the flush lever arm holder 32 is secured to front wall 16. It is noted that water level 12 in the tank is at its at-rest ready-to-use level. Also noted is that float 50 is under water. The partial flush has not yet started.

In the at-rest or cocked position, pin 39 is urged up under to engage flush lever arm 24 and held there by the buoyancy of float 50 acting upon extension member 44 which in turn is attempting to raise up (rotate counterclockwise) cam 36. Since flush lever arm 24 is attached to the flapper valve by means of chain or string 25 and the flapper valve is firmly seated in valve seat 26 by the water pressure pushing down upon it (FIGS. 1-3), float 50 is of a size having insufficient buoyancy to raise flush lever arm 24 by raising cam 36 and thus pin 39. It is noted that cam 36 has risen up a small distance off lower stop 40. The invention sits in this cocked position awaiting the operator's use of the toilet, and particularly the partial flush feature of the toilet dual flush mechanism.

Figure 6:
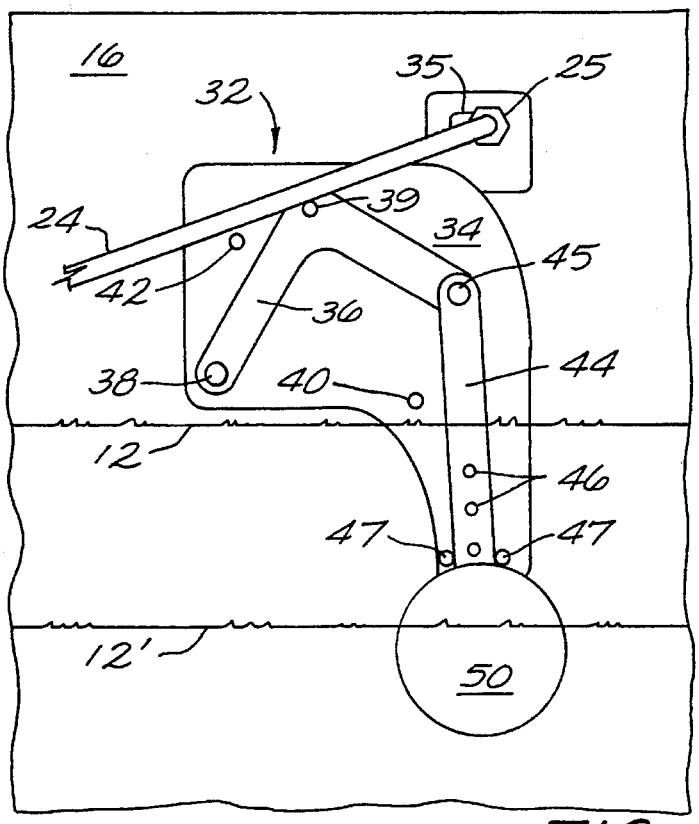
FIG. 6 is a front elevational view of the subject invention in its fully operated position maintaining the flush lever arm in the partial flush position.

FIG. 6 is an illustration showing a front elevation view of the dual flush mechanism actuated for a partial flush. It is noted that, firstly, flush lever arm 24 has been raised or rotated upward from its position shown in FIG. 5 (not a great amount, but sufficient to lift the flapper valve off the valve seat). This was done by the operator pushing down on partial flush handle 22 shown in FIG. 2. As the partial flush handle is depressed, lever arm 24 rotates clockwise (rises up) to the position shown in FIG. 6. This permits cam 36 to begin to rotate counterclockwise about pivot pin 38. This reflects the situation that cam 36 was prior constrained from rotational movement because flush lever arm 24 was holding down pin 39 and only when flush lever arm 24 rises, may cam 36 begin its counter- clockwise rotation. This rotation is accomplished due to the buoyancy of float 50 which is ever tending to attempt to rise to the surface of water level 12.

As flush lever arm 24 has been fully raised to the partial flush position shown in FIG. 6, cam 36 will rotate to the position shown in FIG. 6, allowing pin 39 to move out further on flush lever arm 24 to the point shown. This may or may not have cam 36 engaging upper stop 42, depending upon operator adjustment of the position of base plate 34 relative to opening 35. If not touching, cam 36 will be close to upper stop 42.

Since, as discussed above, the shortcoming of the prior described invention of Toltzman was that it required an operator to hold the partial flush handle down for a period of six seconds or so. When the operator releases partial flush handle 22 (FIG. 2), flush lever arm 24 does not move down as it would otherwise, but is held up by pin 39 of cam 36. The forces attempting to return the flapper valve back to the valve seat are not sufficient to overcome the buoyancy of float 50 operably holding up the flush lever arm. In the event that the invention were fitted upon front wall 16 such that rotation of cam 36 was terminated by upper stop 42, then flush lever arm 24 would be slightly above pin 39. In such case, flush lever arm 24 would drop just a very short distance to pin 39, but not a sufficient drop to allow the flapper valve to re-seat upon the valve seat. In both cases, pin 39 thus holds flush lever arm 24 in the partial flush position after the operator has released the partial flush handle.

The next step is to return flush lever arm 24 to its rest position (allowing the flapper valve to re-seat upon the seat valve) after sufficient water has flowed out of the tank to effect the partial flush. This is accomplished as the water falls to water level 12' shown in FIG. 6. As the water level falls, there will be a level at which float 50 is no longer sufficiently buoyant to hold up flush lever arm 24 and cam 36 will begin its return to its at-rest position shown in FIG. 5.

As float 50 begins to descend with the falling water level and helped by the force of flush lever arm 24 pushing down on pin 39, cam 36 begins its clockwise rotation, allowing pin 39 to fall and allowing flush lever arm 24 to fall also. After a short while, flush lever arm 24 will have fallen sufficiently that the flapper valve re-seats upon the valve seat (FIG. 1) and water will cease to flow into the toilet bowl from the tank. Downward movement of float 50 then will cease and the tank will begin to re-fill.

As the tank fills to its full capacity, since float 50 is not sufficiently buoyant to lift the flush lever arm (lift the flapper valve off the valve seat against the water pressure pushing it down), float 50 does not rise above the position shown in FIG. 5, and only keeps pin 39 urged against flush lever arm 24, awaiting for the next flush, thus completing a partial flush cycle.

In the event a full flush is initiated by depressing the full flush handle, flush lever arm 24 is raised to its full flush position (FIG. 3), considerably above the position shown in FIG. 6. This allows float 50 to operably rotate cam 36 counterclockwise until it hits upper stop 42. This will happen immediately upon the lifting of the flush lever arm 24. Cam 36 will remain against upper stop 42 until water level 12 in the tank falls nearly below float 50, at which time, the weight of the cam 36, extension member 44, and the float itself are sufficient to rotate cam 36 clockwise back to its position engaging lower stop 24. The invention will then rest in this configuration during the full flush. As the flush terminates and the water refills the toilet tank and reaches float 50, the float will again become buoyant and rotate cam 36 counterclockwise to urge pin 39 against the underside of flush lever arm 24 until the string or chain connecting flush lever arm 24 to the flapper valve becomes taunt. The upward buoyant force exerted by float 50 is not sufficient to lift the flapper valve off the valve seat. Thereafter, the tank will continue to fill, but there will be no more movement of cam 36. Cam 36 is now cocked and ready for the next partial flush.

Float 50 is experimentally adjusted to various levels upon extension member 44 by inserting outwardly extending boss 52 (FIG. 4) into the appropriate hole 46 so that sufficient water flows out of the tank to effect the partial flush. The appropriate amount of water for a partial flush will be reflected in a lower water level line.

In the preferred embodiment as well as most of the elements of the alternate embodiments next discussed, parts of the invention were constructed from durable plastic, including the air bladder type float.

Figure 7:
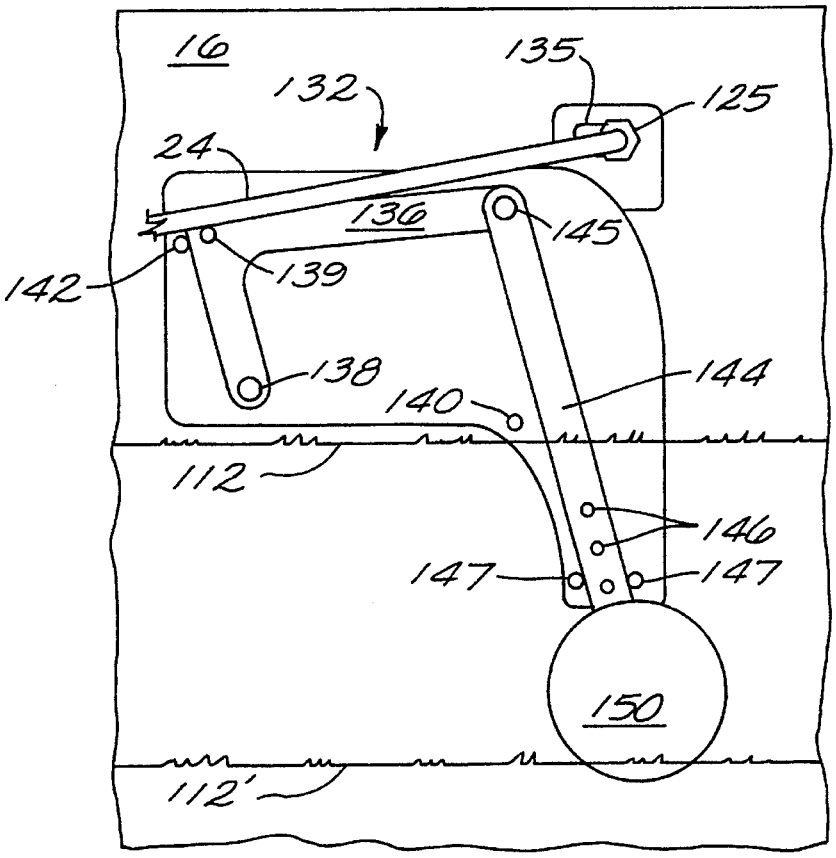
FIG. 7 is a front elevational view of a first alternate embodiment of the invention.

Referring now to FIG. 7, an alternate embodiment of the invention is shown wherein all of the components are substantially the same as in the preferred embodiment with the exception that upper stop 142 has been moved to the left from its position shown in FIGS. 4–6. The new position of upper stop 142 is carefully determined so that rotatable cam 136 rotates counterclockwise from its at-rest position (similar to that shown in FIG. 5) to a position where pin 139 engaging the underside of flush lever arm 24 is just a couple of degrees past top dead center. By that is meant that pin 139 position relative to flush lever arm 24 is a couple of degrees past an imaginary line drawn perpendicularly to the centerline of flush lever arm 24 passing through the center of pivot pin 138.

In the illustration shown in FIG. 7, the alternate embodiment of the invention is detailed with flush lever arm 24 in the raised position of a partial flush, just holding the flapper valve off the valve seat. As flush lever arm 24 is being continually pulled down due to the combined forces of pressure on the flapper valve as well as the suction action of the water upon the flapper valve as the water is draining from the tank through the valve seat, the flush lever arm presses down on pin 139. This causes cam 136 to rotate downward, now counterclockwise, to hit and stop at upper stop 142.

By this means, lever arm 24 is now firmly held in place and is not dependent upon float 150 operating through pin 139 to hold flush lever arm 24 elevated in the continued partial flush position.

Cam 136 shown in FIG. 7 will remain in the same locked position until the water level drops to or below float 150. At that time, the weight of float 150, being no longer buoyant, is sufficient to pull cam 136 clockwise from under flush lever arm 24 and return cam 136 to its at-rest position, similar to the position shown in FIG. 5. This permits flush lever arm 24 to fall and allows the flapper valve to re-seat upon the seat valve, terminating the partial flush.

An obvious difference between the preferred embodiment of FIGS. 4–6 and the alternate embodiment of FIG. 7 is that returning cam 136 of FIG. 7 to its at-rest position depends upon the weight of float 150 (no longer buoyant) pulling upon cam 136 to rotate it clockwise. In the preferred embodiment of FIGS. 4–6, it was float 50 following the falling water level that allowed the flush lever arm to fall as the pin attached to the cam fell and return the cam to its at-rest position.

In the preferred embodiment, the float may well be a very light bladder type float whereas in the alternate embodiment of FIG. 7, the float will need be made of a material much more dense per unit volume than a bladder type float since its weight is needed. Plastic material with a density less than water may still serve as the float.

Aside from the differences mentioned above, the invention of the alternate embodiment contains a similar base plate 132 and an elongated extension member 144 as did the preferred embodiment. Lower stop 140 remains substantially the same, as do guides 147.

The invention of the alternate embodiment shown in FIG. 7 works similarly as does the preferred embodiment at the initiation of the partial flush. Here, as flush lever arm 24 is raised by the operator, cam 136 rotates counter-clockwise by virtue of float 150 to contact upper stop 142.

Figure 8:
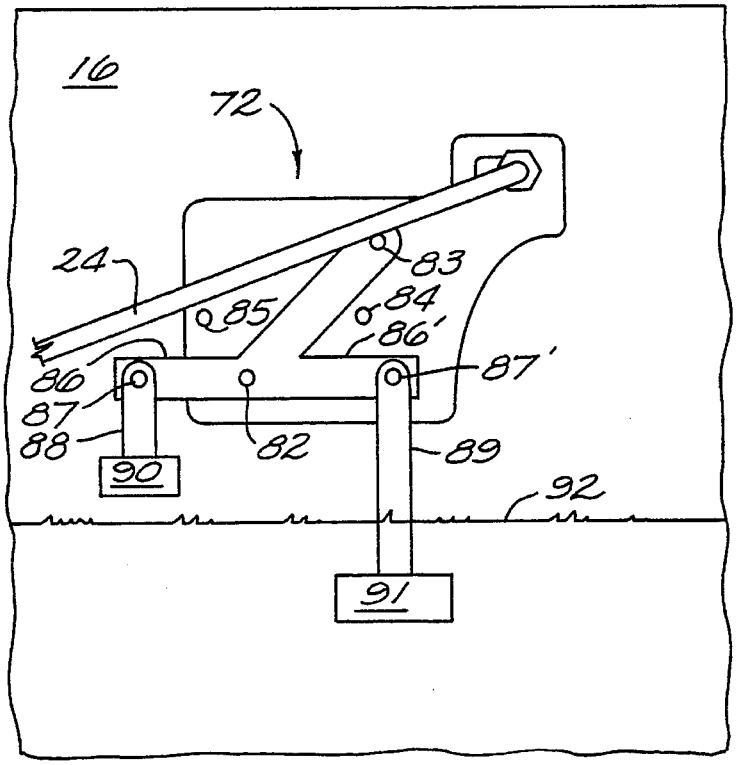
FIG. 8 is a front elevational view of a second alternate embodiment of the subject invention.

A second embodiment 72 utilizing the principles of both the preferred embodiment and the first alternate embodiment is shown in a front elevation view in FIG. 8. In this view, the toilet is shown in its at-rest non-flushing configuration. Here cam 81 rotates around pivot pin 82 with attached outwardly protruding pin 83 adapted to reside under flush lever arm 24. On either side of cam 81 is lower stop 84 and upper stop 85. Attached to cam 81 are equal length arms 86 and 86'. Pivotally attached to the distal ends of arms 86 and 86' are extension members 88 and 89 respectively. Next attached to extension members 88 and 89 at their ends distal to their connection to arms 86 and 86' are light weight 90 and heavy weight 91 respectively. As their names imply, heavy weight 91 weights more than light weight 90. Both weights are denser than water. Water level 92 is shown at the at-rest level prior to an operation mode. Extension members 86 and 86' are of such respective lengths that light weight 90 is above the at-rest water level 92 while heavy weight 91 is submerged.

In the position shown, pin 83 resides under the flush lever arm with cam 81 resting against or near lower stop 84, the flush lever arm at its lower most non-flushing position. Again, the forces holding flush lever arm 24 down are greater than any force acting to rotate cam 81 and thereby raise pin 83.

When the partial flush handle is operated to lift flush lever arm 24, flush lever arm 24 moves above pin 83, thus allowing possible rotation of cam 81. Light weight 90 is so chosen that it will rotate cam 81 in a counterclockwise position, light weight 90 having an effective weight greater than heavy weight 91 so long as heavy weight 91 is submerged. The apparent weight of heavy weight 91 is less than its actual weight since there is a buoyant effect upon heavy weight 91, although heavy weight 91 is not itself buoyant in water.

Cam 81 is thus rotated counterclockwise until it engages upper stop 85 or the underside of the raised flush lever arm 24. In the time required for cam 81 to rotate to its far counterclockwise position, water level 92 falls only a very slight amount, and not below weight 91. Extension members 88 and 89 have such lengths that weight 90 does not drop into the water and weight 91 does not rise out of the water during the counterclockwise rotation of cam 81. As cam 81 rotates counterclockwise, it places pin 83 under flush lever arm 24 in such a position (if cam 81 is intended to reach upper stop 85) that the flush lever arm drops only a slight amount when the operator releases the partial flush lever, even though a partial flush has not yet been fully effected. The flush lever arm engages pin 83 and continues holding the flapper valve above the valve seat in order that the partial flush continue.

The location of upper stop 85 is determined by whether or not one wishes pin 83 to move past top dead center. Obviously, if it is desired that pin 83 be beyond top dead center, upper stop 85 will be more to the left than it would otherwise be. However, for operation of the invention, it is not necessary that pin 83 rotate to a position beyond top dead center, i.e., it could be stopped before that point is reached, either by just stopping rotation of cam 81 with upper stop 85 or by having pin 83 engaging the underside of the flush lever arm.

As the water drains from the toilet tank, water level 92 falls and eventually will fall below heavy weight 91. Heavy weight 91, no longer having the buoyancy effect of the water surrounding it, now exerts an increased downward force on arm 86' such that cam 81 will now rotate clockwise to lower stop 84. Again, flush lever arm 24 will also be pushing down on pin 83 as cam 81 rotates clockwise. When the flush lever arm has returned to its low at-rest position returning the flapper valve to the valve seat, outflow of water ceases and water begins filling the toilet tank until the at-rest water level 92 is achieved.

Once the water has again covered heavy weight 91, then it will no longer be dominate in affecting rotation of cam 81. At this time then, light weight 90 pulling on arm 86 will rotate cam 81 counterclockwise to a position with pin 83 engaging the underside of flush lever arm 24. Again, the weight of light weight 90 is not sufficient to lift flush lever arm 24 such as to pull the flapper valve off the valve seat.

It is realized that in FIG. 8, unequal floats could be utilized instead of weights 90 and 91 wherein the forces would still be acting on arms 86 and 86', although the forces would be in the opposite direction, i.e., upward rather than downward. For example, rather than a downward force on left arm 86 to initially set cam 81 to its counterclockwise most position, an upward force would act on right arm 86'. This upper force would be obtained by a float. And of course the same is true for the downward force acting on right arm 86', it now being an upward force acting on left arm 86. In these cases, movement of left and right extension members 88 and 89 would need be limited to up and down motion by guides attached to arms 86 and 86' since floats attached to the extension members 88 and 89 would tend to rotate the members until the floats were out of the water.

Further, while equal length arms 86 and 86' have been utilized in the alternate embodiment of FIG. 8, thus requiring unequal weights or floats, the lengths of the arms may be varied, along with the weights or floats, in accordance with well known physical principles.

In the preferred and first alternate embodiment of the invention, cam 36 was described as a right angled cam. It is realized that cam 36 could be of most any shape, the important feature being however the placement of pivot pins 38 and 45, and protruding pin 39 upon the cam. In that respect, protruding pin 39 must operate upon the flush lever arm, urged by the float 50, operating through the cam pivot pin 38.

While the invention described above and shown in the figures has been used as an improvement to the prior existing invention of Toltzman (U.S. Pat. No. 4,864,665), it is realized that the instant invention may also be applied to other devices which operate to provide a partial flush by raising the flush lever arm a same small distance against those forces urging the flapper valve to return to the valve seat.

While the invention has been described, disclosed, illustrated, and shown in certain terms or certain embodiments or modifications which it has assumed in practice, the scope of the invention is not intended to be, nor should it be deemed to be, limited thereby and such other modifications or embodiments as may be suggested by the teachings herein are particularly reserved, especially as they fall within the breath and the scope of the claims here appended.

I claim:

1. In a dual flush mechanism for a toilet which raises the flush lever arm of a toilet tank a small distance when a partial flush handle is depressed by an operator, the flush lever arm operably connected to a flapper valve which is raised off a valve seat a similar distance to initiate the partial flush, an improvement for use with the dual flush mechanism to hold the flush lever arm in the elevated partial flush position after the operator releases the partial flush handle to effect a complete partial flush of the toilet, the improvement comprising:

a plate adapted to the operably secured to the toilet tank, said plate so situated as to be proximate the flush lever arm;

a cam pivotally attached to said plate to permit rotation of said cam, said cam rotationally engaging the flush lever arm, said cam including an outwardly protruding holding pin, said holding pin engaging the flush lever arm as said cam rotates to hold the flush lever arm in the elevated partial flush position after the partial flush has been initiated by the operator;

a float operably attached to said cam to cause said cam to rotationally engage the flush lever arm, said float of a size such that its buoyancy in water is sufficient to hold the flush lever arm in the elevated partial flush position after the partial flush has been initiated by the operator but not sufficiently buoyant to rotate said cam prior to the partial flush having been initiated by the operator, and to lower the flush lever arm when the partial flush has been effected to terminate the partial flush, said float having an attachment pin protruding therefrom;

an extension member, said extension member operably attached to said float and pivotally attached to said cam to cause said cam to rotate, said extension member having a plurality of attachment openings to receive said float attachment pin, said float position on said extension member adjustable to vary the duration of the partial flush; and means to guide the movement of said extension member, said means to guide said extension member attached to said plate whereby when an operator depresses the partial flush handle to initiate the partial flush and then releases the partial flush handle, the partial flush will continue until it is completed.

2. The improvement to the partial flush mechanism as defined in claim 1 further including an upper stop, said upper stop attached to said plate, said upper stop engaging said cam to limit said cam's rotational movement in one direction.

3. The improvement to the dual flush mechanism as defined in claim 2 further including a lower stop, said lower stop attached to said plate, said lower stop engaging said cam to limit said cam's rotational movement in a second direction.

4. The improvement to the dual flush mechanism as defined in claim 3 wherein said upper stop and said lower stop are situated on opposite sides of said cam to provide limited rotational movement of said cam between said stops.

5. The improvement to the dual flush mechanism as defined in claim 4 wherein the flush lever arm is elongated and has a longitudinal center line, and said upper stop is situated at a point on said plate to limit rotational movement of said cam such that less than a right angle is formed between the longitudinal center line of the flush lever arm and the cam pivot pin.

6. The improvement to the dual flush mechanism as defined in claim 5 wherein the flush lever arm is elongated and has a longitudinal center line, and said upper stop is situated at a point on said plate to limit rotational movement of said cam such that greater than a right angle is formed between the longitudinal center line of the flush lever arm and the cam pivot pin.

7. The improvement to the dual flush mechanism as defined in claim 6 wherein said cam pivotally attached to said plate is pivotally attached to said plate by a cam pivot pin attached to said plate, and said extension member pivotally attached to said cam is pivotally attached by an extension member pivot pin attached to said cam, said cam pivot pin situated distal said extension member pivot pin.

8. The improvement to the dual flush mechanism as defined in claim 7 wherein said holding pin is interposed said cam pivot pin and said extension member pivot pin so as to form a triangle between said cam pivot pin, said extension member pivot pin, and said holding pin.

9. The improvement to the dual flush mechanism as defined in claim 4 wherein the dual flush mechanism is attached to the toilet tank by a threaded nut engaging a threaded bushing protruding through the toilet tank, said plate having an elongated rectangular opening therethrough to receive the bushing and be secured by the threaded nut of the dual flushed mechanism, said plate secured to the toilet tank.

10. In a flush type toilet having a flush lever arm connected to a flush handle which is depressed by an operator, the flush lever arm operably connected to a flapper valve which is raised off a valve seat to permit water to flow through the valve seat to effect a flush of the toilet, an improvement to provide a partial flush of the toilet when the operator depresses the flush handle by a small amount to raise the flush lever arm so that the flush lever arm raises the flapper valve just off the valve seat a small distance insufficient for the flapper valve to become fully buoyant, said improvement holding the flush lever arm in an elevated partial flush position after the operator releases the flush handle to effect a complete partial flush of the toilet, the improvement comprising:

a plate adapted to the operably secured to the toilet tank, said plate so situated as to be proximate the flush lever arm;

a cam pivotally attached to said plate to permit rotation of said cam, said cam rotationally engaging the flush lever arm, said cam including an outwardly protruding holding pin, said holding pin engaging the flush lever arm as said cam rotates to hold the flush lever arm in the elevated partial flush position after the partial flush has been initiated by the operator;

a float operably attached to said cam to cause said cam to rotationally engage the flush lever arm, said float of a size such that its buoyancy in water is sufficient to hold the flush lever arm in the elevated partial flush position after the partial flush has been initiated by the operator but not sufficiently buoyant to rotate said cam prior to the partial flush having been initiated by the operator, and to lower the flush lever arm when the partial flush has been effected to terminate the partial flush, said float having an attachment pin protruding therefrom;

an extension member, said extension member operably attached to said float and pivotally attached to said cam cause said cam to rotate, said extension member having a plurality of attachment openings to receive said float attachment pin, said float position on said extension member adjustable to vary the duration of the partial flush; and means to guide the movement of said extension member, said means to guide said extension member attached to said plate whereby when an operator depresses the partial flush handle to initiate the partial flush and then releases the partial flush handle, the partial flush will continue until it is completed.

* * * * *